United States Patent [19]

Sieurin

[11] 3,940,264

[45] Feb. 24, 1976

[54] METHOD OF DISTRIBUTING MOLTEN METAL TO CONSUMER STATIONS

[75] Inventor: Sven Ivar Sieurin, Upplands Vasby, Sweden

[73] Assignee: Granges Essem Aktiebolag, Vasteras, Sweden

[22] Filed: May 31, 1973

[21] Appl. No.: 365,746

[30] Foreign Application Priority Data

June 5, 1972 Sweden ..... 7370/72

[52] U.S. Cl. ..... 75/65 R; 75/96; 164/337

[51] Int. Cl.[2] ..... C22B 9/12; B22D 35/04

[58] Field of Search ..... 75/65 R, 46, 13, 61, 96; 164/337, 266; 221/1

[56] References Cited

UNITED STATES PATENTS

| | | | |
|---|---|---|---|
| 1,866,682 | 7/1932 | Temmen | 164/337 X |
| 3,206,301 | 9/1965 | Daubersy | 164/337 X |
| 3,324,935 | 6/1967 | Wertli | 164/337 X |
| 3,700,025 | 10/1972 | Tenner | 164/337 X |
| 3,786,962 | 1/1974 | Van Linder | 164/337 X |
| 3,814,167 | 6/1974 | Listhuber et al. | 75/61 X |

FOREIGN PATENTS OR APPLICATIONS

| | | |
|---|---|---|
| 400,259 | 10/1933 | United Kingdom |
| 932,177 | 7/1963 | United Kingdom |

*Primary Examiner*—Allen B. Curtis
*Assistant Examiner*—Thomas A. Waltz
*Attorney, Agent, or Firm*—Haseltine, Lake & Waters

[57] ABSTRACT

A method of distributing molten metal to consumer points is described, in which molten metal is caused to run under gravitational forces from a container to different consumer points through a system of generally horizontal passages. As the molten metal is consumed at the consumer points fresh metal is charged to the molten metal container to maintain a generally constant, predetermined level of molten metal in the container and in the system of passages.

7 Claims, 2 Drawing Figures

METHOD OF DISTRIBUTING MOLTEN METAL TO CONSUMER STATIONS

Figure 1:
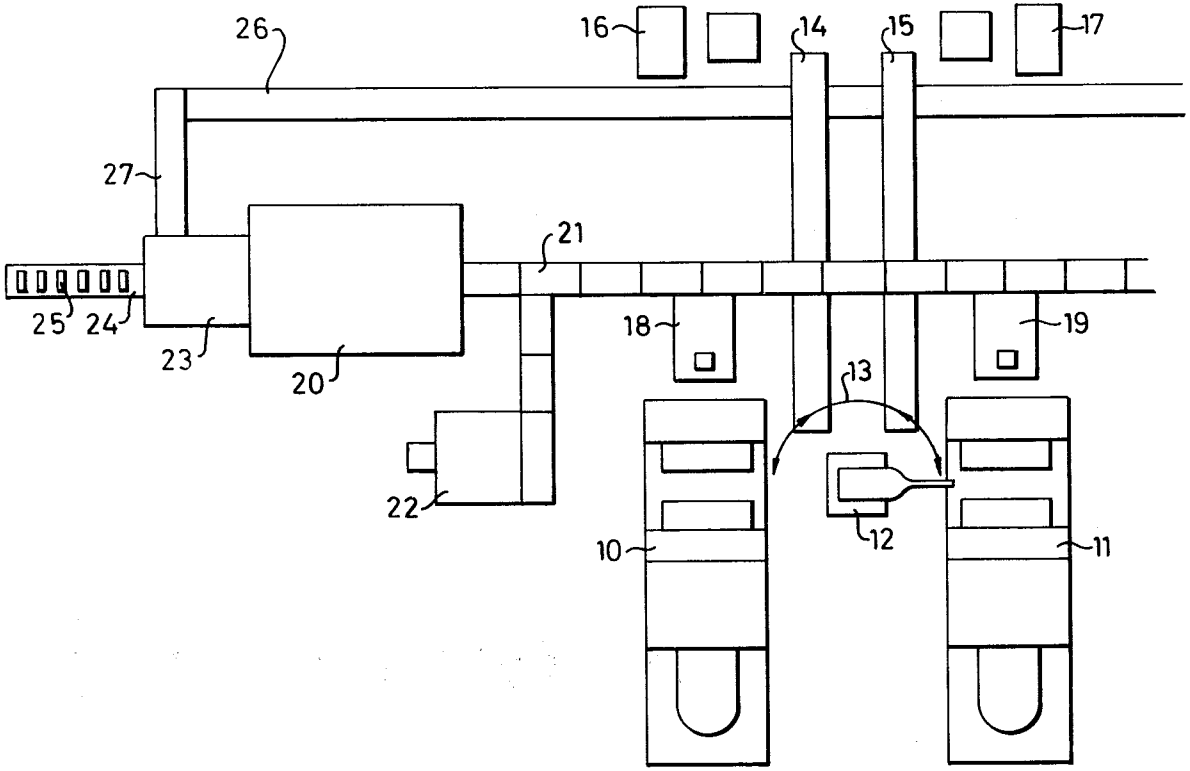

The present invention relates to a method of distributing molten metal to consumer stations.

For the purpose of distributing molten metal to consumer stations, e.g. in the form of casting machines, there has normally previously been used a relatively large melting furnace from which pre-determined quantities of molten metal has been picked up by means of ladles or like devices and conveyed to the different consumer stations. The conveyance of the molten metal to the consumer stations is controlled manually in a manner such that all consumer stations are charged with molten metal essentially at the rate at which said stations consume the metal. When the consumer stations have the form of casting machines, it has been normal practise to use heat-retaining or holding furnaces, the construction of such furnaces varying in dependence, inter alia, of the principle on which the casting machine works. One of the simplest methods in this respect is to use a hand ladle to pick up molten metal from a transportable container, which in turn is arranged to pick up molten metal from a common melting furnace, and to pour suitable portions of the molten metal from the ladle into the receiving vessels of the different casting machines or holding furnaces. This method requires a considerable amount of manual work which, although possibly acceptable with smaller systems, can be encumbered with serious drawbacks when distributing molten metal to large casting systems.

With another known method, molten metal is conveyed in a transportable ladle from a central melting furnace and poured from the ladle into so-called heat-retaining or holding furnaces arranged adjacent the casting machines. With regard to simplicity and convenience of distribution this method is relatively advantageous, but both of the aforementioned known methods present a problem in the form of oxidation of the distributed metal, since the surface of the molten metal is exposed to the influence of air, both in the manually operated ladle and the transportable ladle, wherewith the exposed surface layer of the molten metal is strongly oxidized and frozen as a result of the large difference between the temperature of the melt and the air.

When, as is many times the case, fresh, solid melt goods, e.g. in the form of pigs or ingots are charged to the melt and/or the heat-holding furnaces, the ingots or pigs in the relatively limited spaces of the furnaces will stir the oxides in the surface layer of the melt and also the frozen portions of said surface. This stirring of the melt is undesirable, since it can result in the presence of troublesome inclusions in the cast products or uneveness in the metal structure thereof.

With the former of the two aforementioned methods, in which limited quantities of molten metal are poured stepwise into the receiving vessel of the casting machine or to heat-holding furnaces, the molten metal will each time be subjected to oxidation and freezing. This is also true for the molten metal charged to the casting machines by means of tiltable ladles, since the molten metal flowing from the ladle is also subjected to strong cooling and a substantial surface thereof is exposed to oxidation by the surrounding air. Furthermore, charging of the molten metal to the heat-holding furnaces causes the temperature of the melt to vary in a very undesirable manner, which can give rise to nucleations in the melt.

The prime object of the invention is to avoid substantially excessive agitation of the distributed molten metal and to ensure that said metal is charged to the receiving stations as gently as possible. A further object of the invention is to distribute the metal in a manner such that it is not exposed to the influence of the outer air while being distributed. Another object of the invention is to enable the molten metal to be distributed substantially automatically, so that charging of the molten metal to the consumer stations from a main melting furnace takes place substantially at the same rate as the molten metal is consumed at said stations, i.e. the casting machine.

Another object of the invention is to provide a method and a device for charging at least a main melting furnace with solid metal goods, which may comprise pigs or ingots or scrap return material, in a manner which prevents the oxide layer on the molten metal from being broken in a manner to cause subsequent problems, said oxide layer being unavoidable even when the molten metal is well shielded from the outer air.

A further object of the invention is to distribute the molten metal as slowly as possible and to maintain the surface of the metal in the melt system as constant as possible and to utilize to the greatest possible extent, for distributing said metal to said consumer stations, self-running of the metal from the main smelt furnace to the different consumer stations, e.g. the casting machines.

In accordance herewith the invention is mainly characterized by passing metal from a molten metal container under the force of gravity, i.e. self-running, in substantially horizontal passages to the different consumer stations, and by maintaining in the container and passages a predetermined, substantially constant level of molten metal by supplying, preferably automatically, to the molten metal in the container fresh metal substantially at the same rate as the metal is consumed at the consumer stations.

In accordance with a preferred embodiment of the invention, the molten metal in the container and in the distributing passages is permitted to run off at a speed so restricted that the layer of impurities on the surface of the melt is retained substantially unbroken.

The invention also relates to a device for carrying out the method, said device being substantially characterized by a molten metal container arranged to communicate through substantially horizontal passages with the different consumer stations, there being co-ordinated with the container a conveying means which is controlled in response to the consumption of metal so as to automatically hold the surface of the molten metal in the container and the passages substantially at a fixed level.

With a particularly preferred embodiment of the device according to the invention, the discharge end of the conveyor means is located, at least when in its discharge position, closely adjacent the level of the molten metal.

The invention will now be described in more detail with reference to an embodiment thereof illustrated diagrammatically in the enclosed drawing, further features of the invention being made apparent in connection therewith. In the drawing, FIG. 1 is a diagrammatic plan view of a system according to the invention for distributing molten metal to consumer stations, for example the indicated die-casting machines, and FIG. 2 is a vertical section of a main melting furnace forming part of the system for distributing molten metal to the diecasting machines graphically shown in FIG. 1.

Figure 2:
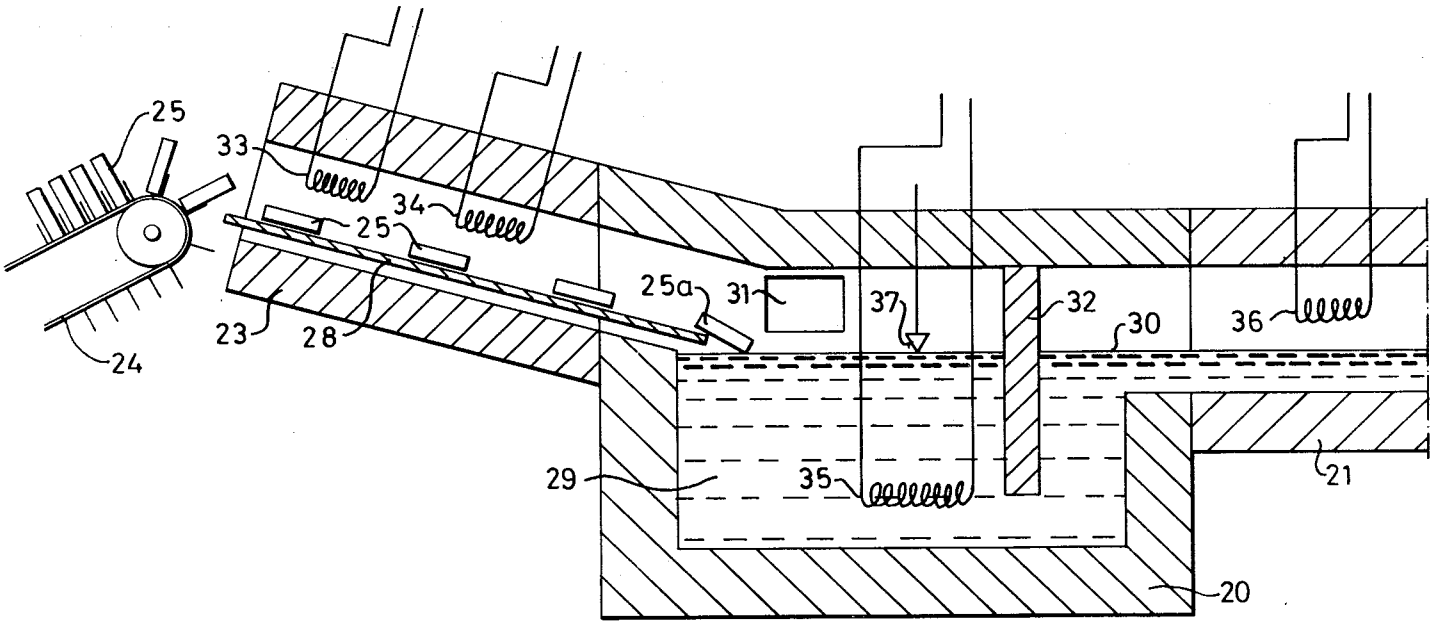

In FIG. 1, the reference numerals 10 and 11 indicate two separate die-casting machines, which are assumed to have a construction preferred in the present connection. The two machines are served by a common, so-called industrial robot 12 which removes the finished cast goods from the machines and which controls the operation of said machines in a manner such as to prevent them from continuing a casting operation before the robot has removed the finished, cast goods and established that the molds are empty. The arrowed arcuate line 13 indicates the main movement path of the robot, at least when seen in plan view.

The robot 12 delivers the finished, cast goods to conveyors 14 and 15 which transport the goods to trimming stations, generally shown at 16 and 17 respectively.

For each die-casting machine 10 and 11 there is arranged a heat holding furnace 18 and 19 respectively, which receive molten metal from a melting furnace 20 via a closed system of passages 21 which is heat-insulated in a suitable manner. Communication through the passage system 21 is such that a constant level is substantially maintained in said system and the holding furnaces 18 and 19. Coordinated with the system of passages is a furnace 22 for recovering metal from slag, the slag being now and then skimmed from the melting furnace 20. The melting furnace is also co-ordinated with a pre-heating furnace 23, in which solid metal is dried and pre-heated to temperatures suitable for charging the metal to the melt initially present in the melting furnace 20.

The pre-heating furnace is charged by means of a suitable conveyor 24, which, for example, supplies to said furnace metal ingots, pigs or the like 25 at a rate suitable for carrying out the total process in dependence on the amount of molten metal consumed by the die-casting machines 10 and 11.

With the system shown in FIG. 1 it is assumed that scrap such as sprue flashes and the like removed from the cast metal goods at stations 16 and 17 is recovered and returned to the melting furnace 20 in a circulating process. To enable this scrap material to be handled in a convenient manner, there is provided in the system shown in FIG. 1 a conveyor 26 for return material, i.e. scrap, which feeds the material into the pre-heating furnace through a side conveyor 27 at a rate which may be determined essentially by differences in the surface level of the volume of molten metal in the melting furnace.

In accordance with an alternative feature, the pre-heating furnace of the melting furnace may be charged solely with ingots or pigs by means of the conveyor 24 or solely with scrap by the conveyor 27, whereby either one of the two conveyors may be temporarily activated. In accordance with a third alternative, the feed by means of conveyor 24 and conveyor 27 may be co-ordinated in a manner such that the two conveyors together charge the pre-heating furnace with the requisite material to constantly maintain the operation of the system.

Reference is now made to the embodiment shown in FIG. 2, which is a vertical sectional view in detail of the melting furnace 20, the pre-heating furnace 23 and part of the system of passages 21. The Figure also shows a part of the conveyor 24 with ingots or pigs or the like 25 conveyed thereon.

In the pre-heating furnace 23 there is arranged a further conveying means 28, which, for example, may be of the shaking or vibrating type and which is arranged to feed the solid metal goods, which may comprise the ingots 25 or scrap or both ingots and scrap, in a direction obliquely downwardly towards the molten metal 29 in the melting furnace 20, into which molten metal the solid metal goods are relatively carefully placed substantially on the level of the surface layer 30 of the melt, which surface layer for natural reasons consists of slag, i.e. impurities and metal oxides. For the purpose of removing this layer there is arranged in the wall of the furnace 20 a so called slag removal opening 31 through which a scoop or the like is inserted in a conventional manner to skim off the slag. As shown in the Figure, the melting furnace 20 has built therein a partition wall 32 which extends through the layer of slag 30 down into the molten metal. The partition wall 32 is intended to prevent the relatively large quantity of slag formed in the melting furnace from being passed to and through the distribution passage 21 to the holding furnaces. Arranged in the pre-heating furnace 23 are sources of heat, which for the sake of simplicity have been shown as electrical resistance heating elements. These elements are shown in the Figure by the reference numerals 33 and 34 respectively.

Heating elements are also arranged in the molten metal 29 in the melting furnace, said heating elements being shown in the form of electric resistance element 35. The design of the heat sources or the type of heat sources used is not restricted, however, to the electrical resistances shown in the drawing, but may comprise any appropriate type of heat source. The system of passages 21 may also be provided with heating elements, of which one is shown at 36. The illustrated embodiment also includes a level monitor 37, which constantly senses the surface level of the molten metal in the furnace and therewith also essentially the level in the distribution passage system, although normally with a certain time delay between the furnace and the passage system. In accordance with the invention, the level monitor may be so connected to the drive means of the conveyors 24, 26 and 27 that said conveyors, either singly or together, charge the quantity of solid metal goods to the pre-heating furnace required to maintain a constant surface level of the molten metal in the distribution systems in order to maintain the die-casting machines in productive operation.

With regard to the pre-heating furnace 23 it can be mentioned that on the part of both the ingots 25 and the returned scrap the furnace is dried, wherewith water, oil and other lubricants or chemical solvents are first removed simultaneously as the solid metal goods are preheated to a suitable temperature before said goods are placed in the melt 29 in the melting furnace 20.

When placing the solid goods into the melt, a vibrating conveyor 28 is arranged to relatively carefully tip the goods down through the slag layer 30, wherewith an ingot or the like, such as that shown by the reference 25*a* in the Figure, preheated to a relatively high temperature, although not melting temperature, passes locally through the slag layer while practically simultaneously melting upon contact with the molten bath. In this way, the layer of slag-forming impurities 30 on top of the molten metal 29 is left substantially undisturbed and the risk of parts of the layer penetrating the molten metal 29 to cause undesirable inclusions therein is substantially avoided, such inclusions otherwise accompanying the molten metal when said metal is distributed to the consumer stations. In addition, the method causes the minimum of slag to be formed when the ingots are melted, since melting of the ingots takes place essentially at or beneath the level of the molten metal, i.e. in the absence of air. Further, it is assumed in accordance with the invention that the volume of molten metal 29 is so considerable compaired with the volume of the ingots or scrap passed to the melt per unit of time that the temperature of the melt is not essentially changed as a result of the charge. The metal is thus distributed from the melting furnace through the system of passages 21 by gravitational forces, i.e. self-running, in a particularly uniform manner at very low speeds, which is necessary in order for the system to provide a maximum yield with respect to the quality of the final product. The closed structure of the entire distributing system from the pre-heating furnace and the melting furnace and the distribution passage 21 provide a fully closed structure which prevents in a particularly effective manner both freezing and oxidizing effects in the distributed melt. The closed structure prevents the furnace atmosphere from being through passed by air, so called drafts, which means that only a minimum amount of heat need by supplied to the system. This enables inexpensive and simple heat sources to be used, which renders the system very economical. The aforedescribed system gives good results both with respect to economy and quality.

The invention is not restricted to the illustrated and described embodiments thereof, but can be modified within the scope of the accompanying claims. Thus, it can be used to distribute molten metal to such consumer stations as those used for sand molding and gravity die-casting.

What is claimed is:

1. A process for distributing molten metal to consuming stations comprising the steps of providing a supply of molten metal in a heat insulated container having an enclosed atmosphere to establish a column of said molten metal in said container, the surface of said molten metal being exposed to said enclosed atmosphere in said container, while supplying heat to said column of molten metal to keep it at a desired temperature; leading off said molten metal from said container at a level substantially below the exposed surface of said column and passing it in open communication into one or more closed heat insulated and substantially horizontal distributing passages enclosing an atmosphere, to establish and maintain a substantially constant surface level of said led-off molten metal common to said container and said passages; supplying heat to said passages to keep the molten metal therein at a desired temperature; removing the molten metal from said passages at said consumer stations, thereby establishing and retaining on said molten metal in said container and passages a covering layer of slag formed in situ on said molten metal; and adding fresh solid metal to said supply of molten metal through said layer of slag in said container in such a manner as to maintain said slag layer on the surface of the molten metal in said container substantially undisturbed and to maintain said slag layer in said passages substantially unbroken.

2. A process according to claim 1 wherein the enclosed atmosphere above the surface of the molten metal in said container and said passages is an oxidizing atmosphere.

3. A process according to claim 1, wherein the rate of withdrawal of said molten metal from said passages and the rate of adding fresh metal to said supply of molten metal is restricted whereby said metal flows in said passages at a speed slow enough to avoid disrupting said surface slag layer.

4. A process according to claim 1 wherein said fresh metal is introduced into said supply of molten metal in solid form.

5. A process according to claim 1 wherein said fresh metal is preheated before being introduced into said supply of molten metal.

6. A process according to claim 1 wherein said fresh metal is introduced into said supply of molten metal by sliding through said slag layer.

7. A process according to claim 1 wherein the level of said molten metal is sensed by a level monitor which controls the rate of addition of fresh metal to the supply of molten metal whereby a constant level of molten metal is maintained in said container.

* * * * *